United States Patent [19]

Seeley

[11] 4,338,264

[45] Jul. 6, 1982

[54] WATER DISTRIBUTION MEANS FOR AN EVAPORATIVE AIR COOLER

[75] Inventor: Frederic F. Seeley, St. Marys, Australia

[73] Assignee: F. F. Seeley Nominees Pty. Ltd., St. Marys, Australia

[21] Appl. No.: 134,058

[22] Filed: Mar. 26, 1980

[30] Foreign Application Priority Data

Mar. 26, 1979 [AU] Australia ..... PD8219

[51] Int. Cl.[3] ..... B01F 3/04

[52] U.S. Cl. ..... 261/29; 261/106; 261/DIG. 4

[58] Field of Search ..... 261/106, DIG. 15, DIG. 4, 261/29

[56] References Cited

U.S. PATENT DOCUMENTS

| | | | |
|---|---|---|---|
| 3,191,915 | 6/1965 | Goettl | 261/106 |
| 3,348,822 | 10/1967 | Vieceli et al. | 261/DIG. 15 |
| 3,774,588 | 11/1973 | Yeagle | 261/DIG. 15 |
| 3,791,633 | 2/1974 | Lowe | 261/DIG. 15 |
| 3,867,486 | 2/1975 | Nagele | 261/DIG. 4 |
| 3,975,470 | 8/1976 | Engel | 261/106 |
| 4,158,679 | 6/1979 | Yeagle | 261/106 |

*Primary Examiner*—Tim R. Miles

*Attorney, Agent, or Firm*—Jay L. Chaskin

[57] ABSTRACT

An evaporative air cooler including improved means for distributing water through the evaporative pad of the cooler through which air is drawn for cooling, the improved water distributing means comprising a tray-like member having a water inlet arranged to introduce water at an approximate central location on said tray-like member, and a plurality of radially outwardly extending water-flow channels extending between the water inlet location and a peripheral edge portion of the member, the tray-like member being located relative to the evaporative pad such that, during use, water issuing from the water flow channels runs downwardly through the evaporative pad.

8 Claims, 7 Drawing Figures

WATER DISTRIBUTION MEANS FOR AN EVAPORATIVE AIR COOLER

This invention relates to an improved evaporative air cooler, more specifically to improved water distribution means for distributing water into and through the evaporative cooler pad of the air cooler.

BACKGROUND OF THE INVENTION

One well known form of an evaporative air conditioner utilises a blower contained within a box-like structure having four sides at least one of which contains a pad assembly in which there is contained fibrous absorbent material, there being a water distribution conduit located at the top of the pad for distributing water over and through the pad, the blower drawing air inwardly through the wetted absorbent material contained in the pad which is designed to provide a large surface area for evaporation of the water which is distributed therethrough. One of the main practical difficulties encountered with this type of conditioner has been attributed to the nonuniform distribution of water through the fibrous absorbent material of the pad assembly. In an attempt to resolve this problem, the water distribution conduit was provided with a plurality of apertures spaced along the length thereof; however, under certain circumstances, the apertures become ineffective or only partially effective, for example through the conduit not being horizontal, the water supply having insufficient pressure, or corrosion of the metal surrounding the apertures (in the case where the conduit is formed of metal), as a result of which the apertures may become blocked or partially blocked. It is well known that in the event of blockage of the apertures in the water distribution conduit, the efficiency of the air conditioner is seriously impaired.

A further difficulty associated with prior art air conditioner assemblies has been in the assembly of the component parts of the cooler, and in particular the problem of locating and fitting the water distribution conduit in its correct position in the cooler body has always been a prominent one.

SUMMARY OF THE INVENTION

It is the main object of the present invention to provide improved water distribution means for an evaporative air conditioner whereby water flow to the cooler pad assembly is vastly improved and the likelihood of blockages is virtually eliminated.

A still further object of the present invention is to provide an improved water distribution tray which can be readily and accurately located in position in the cooler body, thereby simplifying assembly procedures and assembly costs.

Accordingly, this invention relates to an improved evaporative air cooler having a cooler body including a top panel and side panels, a cooler pad assembly adjacent at least one of the side panels, a blower which, in use, draws air through said cooler pad assembly, a pump which, in use, delivers water to said cooler pad assembly, and a motor to operate said blower and said pump, the improvements comprising: water distribution means comprising a tray-like water distributing member supported with respect to said cooler body, and having walls defining a plurality of outwardly extending water flow channels, and a wall defining a water receiving area, said water flow channels radiating outwardly from said water receiving area and being in water flow communication therewith so that water, when the cooler is in use, flows from said area into the channels and outwardly therealong, a water inlet to said water receiving area, said water inlet being connected to a water delivery line leading from the outlet side of said pump, the relative locations of said tray-like water distributing member and said cooler pad assembly being such that water issuing from the water flow channels runs downwardly through said cooler pad assembly.

Preferably, the water distribution tray is provided with circumferentially spaced upstanding pins or pegs which are arranged to engage in complementary shaped sockets formed in the top panel of the air cooler body. This facilitates the fitting of the distribution tray during the assembly of the cooler body. The water receiving area is preferably circularly shaped (when viewed in plan) and is mutually spaced from the side and rear edges of the tray.

With this arrangement, there is very little likelihood of blockage occurring and furthermore a more controlled flow of water over the whole area of the tray can be achieved.

DETAILED DESCRIPTION OF THE PREFERRED EMBODIMENT

Figure 5:
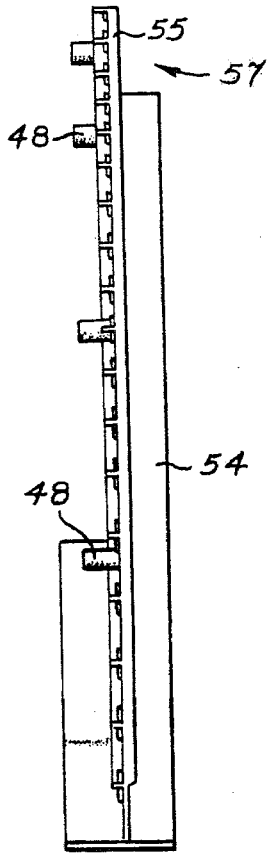
Figure 1:
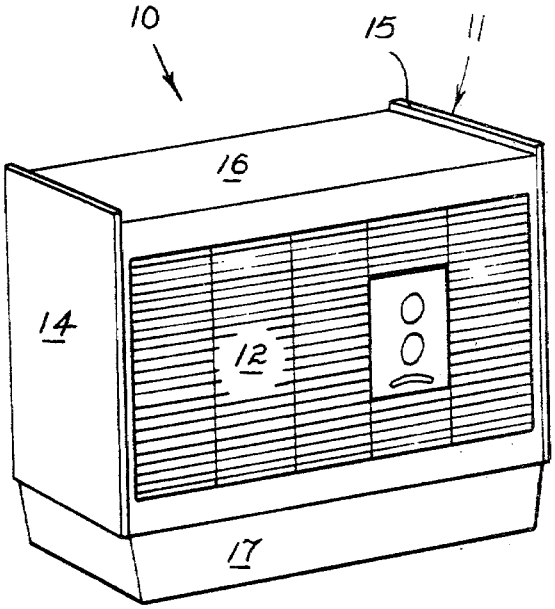
Figure 2:
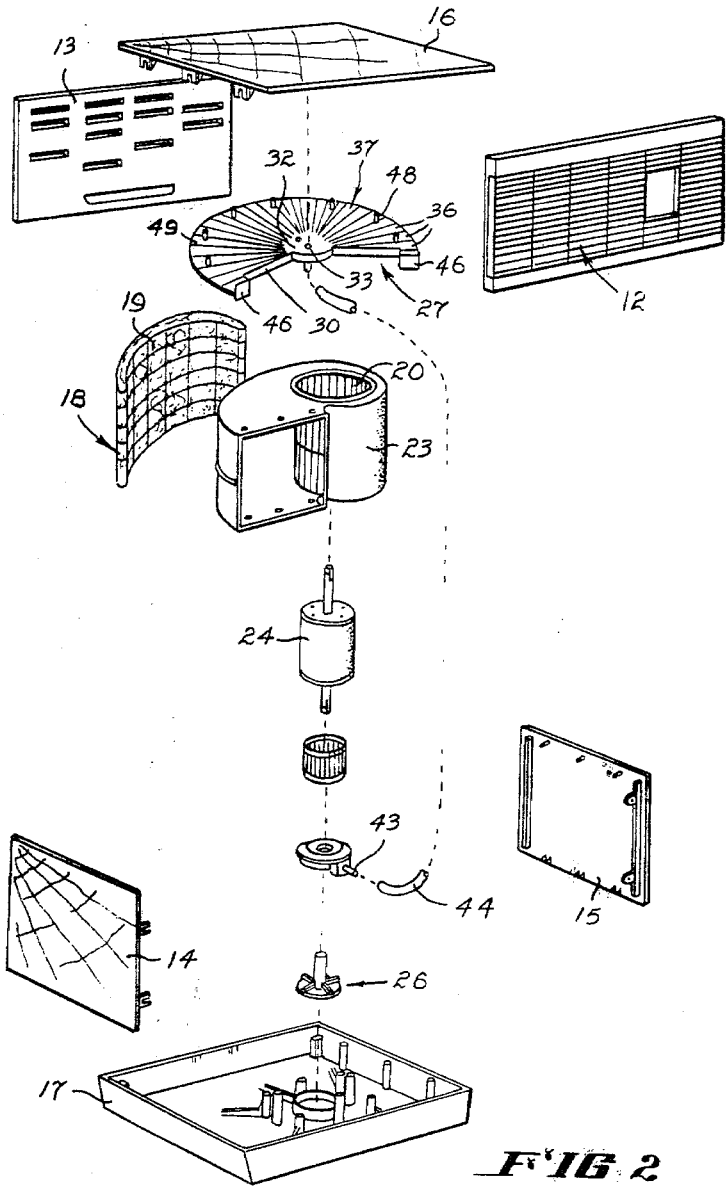
Figure 3:
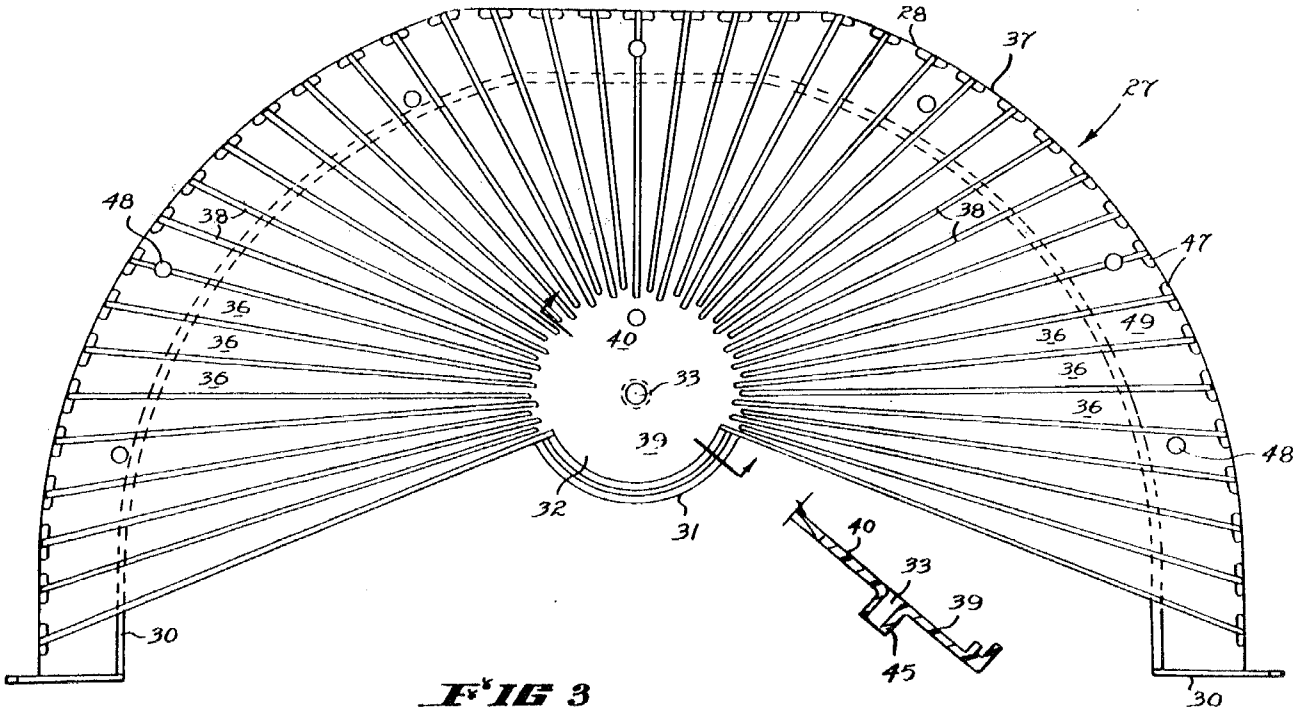
Figure 4:
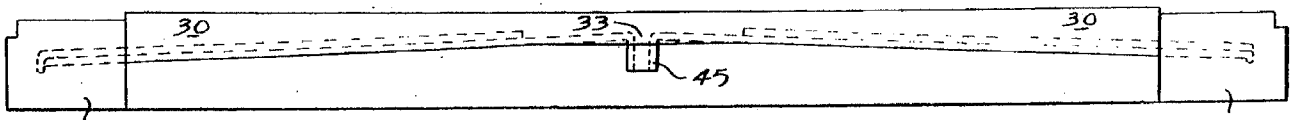
Figure 6:
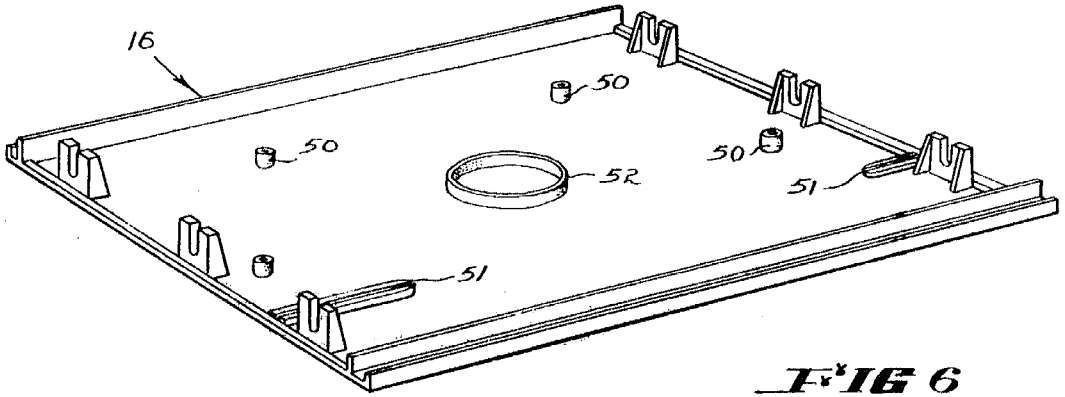
Figure 7:
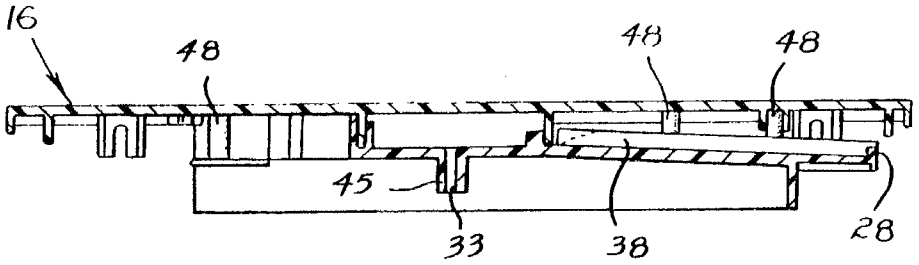

In order to more clearly and fully describe the applicant's invention, an embodiment is described in detail herebelow with reference to the drawings in which:

FIG. 1 is a perspective view of an evaporative air cooler in its assembled form, FIG. 2 is an exploded view of the cooler illustrating the main component parts thereof, FIG. 3 is a plan view of the water distribution tray, FIG. 4 is an end elevation of FIG. 3, FIG. 5 is a side elevation of FIG. 3, FIG. 6 is an underneath perspective view of the top panel of the cooler, and FIG. 7 is a section taken through the top panel and tray in their assembled condition.

In this embodiment, an evaporative air cooler 10 comprises an evaporative cooler body 11 which itself comprises four panel sides 12, 13, 14, 15 a top panel 16 and base tank 17. Adjacent the rear panel 13, there is located a pad assembly 18 comprising an evaporative pad 19 containing a fibrous absorbent material which is arranged to provide a large surface area for evaporation of the water which runs downwardly therethrough. In this embodiment the pad 19 is convexly curved and has its ends turned inwardly away from the rear panel 13. It should be realised that more than one pad can be used, for example one adjacent each of the three sides 13, 14, 15. The blower which includes an impeller 20, impeller housing 23 and motor 24, and the pump 26 for pumping water through the unit, are assembled in the cooler body in known manner as shown in FIG. 2. It will be realised that not all parts of the unit have been shown.

A tray-like water distributing member 27 is located above the blower housing 23 and in this embodiment the member 27 is substantially fan-shaped which includes a partly curved peripheral edge 28 extending around the sides and back of the member 27 and vertical radially inwardly directed front flanges 30, the flanges 30 being joined by a curved flange portion 31. The tray-like member 27 basically comprises two portions, firstly a water receiving area 32 spaced from the edge 28 and provided with a water inlet aperture 33 centrally located thereon, and a series of open-ended radially outwardly extending water flow channels 36. The channels 36 are defined by upper surface portions of the base wall 37 of the tray-like member 27 and the side walls of spaced upstanding ribs 38 integrally formed with the base wall 37 and which extend from the water receiving area 32 to the peripheral edge 28 of the tray-like member 27. In this embodiment portion 39 of the central water receiving area is flat whilst portion 40 slopes slightly downwards away from the aperture 33 and merges smoothly into the bottoms of the water flow channels 36 which are also thus designed to slop slightly downwardly away from the aperture 33. The aperture 33 is thus located in a plane which is slightly displaced above the plane in which lies the peripheral edge of the tray 27.

The spacing between adjacent ribs 38 at their radially inner ends should be sufficiently wide such that foreign matter entrained in the water can pass therethrough without causing blockage. In this embodiment, to further assist in minimising blockage, alternate ribs 38 terminate at their radially inner ends a slight distance shorter with respect to the adjacent ribs and have their ends sloped to form ramp surfaces.

Water which is circulated through the cooler unit 10 by means of the pump 26 is pumped up from the water tank 17 located at the base of the cooler body 11 through the pump outlet 43 into a conduit 44 which is connected to an inlet nipple 45 located on the underside of the traylike member 27 and approximately centrally of the receiving area 32. Water is thus introduced at approximately the centre of the water receiving area 32 from where it flows into the water flow channels 36 which in this embodiment are positioned around the circumference of the water receiving area through an angle of approximately 240°. The remaining circumferential portion of the water receiving area 32 is bordered by the upstanding flange 31. At the radially outer end of each water flow channel 36, there are provided a pair of spaced elongate protrusions 47 which constitute deflector elements so arranged that water which flows outwardly along the channels will be distributed into the fibrous absorbent material in a uniform manner.

In this embodiment, the channels 36 which extend towards the rear panel 13 are generally shorter than those which extend towards the side panels 14, 15. It naturally follows that as the peripheral edge 28 lies in the one plane, the shorter channels are steeper than the longer channels, and this is effective in more water being distributed to the rear of the tray 27 than to the sides thereof. As the blower 20 draws more air at the rear of the body 11 than at the sides thereof, the need for a larger volume supply of water at the rear is greater than at the sides. Thus, more water runs down through the pad 11 in the centre region thereof (where air intake is greater) than through the side regions of the pad 11.

In this embodiment the member 27 has a U-shaped depending flange 54 radially spaced from its periphery and forms with the undersurface portion 55 of the peripheral edge 28 a U-shaped channel 57 which locates and receives the upper portion of the curved pad 19.

The water distribution tray 27 is readily fitted in position by engaging spacer pins or pegs 48, which are integrally formed on the upper surface 49 of the tray 27 within sockets 50 formed on the under surface of the top panel 16 of the cooler body 11. This enables the water distribution tray to be also accurately located. The tray 27 is further located in position by means of engaging outer portions 46 of the flanges 30 in complementary slotted portions 51 on the underside of the top panel 16. The upper edges of the flanges 30 are designed to lie contiguous with (or nearly so) the underside surface of the top panel 16 when the tray is fitted thereto. This is effective in preventing undesirable air currents being set up within the interior of the cooler. It will of course be appreciated that there are a number of other ways of fitting the water distribution tray in position above the blower and aligned so that water running off the tray will pass over and through the fibrous absorbent material.

So that water pumped up through the conduit 44 into the water receiving area 32 flows uniformly into the mouths of the channels 36, in this embodiment a circular depending boss 52 is centrally formed on the underside of the top panel 16 of the cooler body 11, the size of the boss 52 having a diameter which is approximately equal to the diameter of the water receiving area 32 on the water distribution tray 27. When assembled, the depending circular boss 52 on the top wall neatly fits over and surrounds the area 32 of the water tray 27. In use, water is pumped up from the tank 17 at the base of the cooler body 11, passes into the chamber defined by the upper surface of the receiving area 32 and the inner surface of the boss 52 and impinges against the boss upper end formed by the undersurface of the top panel 16 and in turn flows into the water flow channels 36.

In this embodiment, the water distribution tray is injection moulded from plastics material; however, any other suitable noncorrosive material would be suitable.

A brief consideration of the above embodiment will indicate that the invention is extremely simple but nevertheless provides improved means for distributing the water into the fibrous absorbent material of the evaporative pad, with minimum likelihood of blockage. Furthermore, with this invention, the likelihood of unevaporated water being entrained in the air stream and blown through the blower out through the louvred front panel into the room interior is greatly minimised—a problem which is common to many prior art evaporative air coolers. The invention provides an evaporative air cooler the efficiency of which is much higher than that of prior art units.

Various modifications in structure and/or function may be made to the disclosed embodiments by one skilled in the art without departing from the scope of the invention as defined by the claims.

I claim:

1. An evaporative air cooler comprising a cooler body including a top panel and side panels, a cooler pad assembly adjacent at least one of the side panels, a blower which, in use, draws air through said cooler pad assembly, a pump which, in use delivers water to said cooler pad assembly, a motor to operate said blower and said pump, water distribution means comprising a tray-like water distributing member supported with respect to said cooler body adjacent the underside of said top panel and having upstanding ribs defining a plurality of outwardly extending water flow channels, and a wall defining a water receiving area, said water flow channels radiating outwardly away from and sloping downwardly away from said water receiving area and being in water flow communication therewith so that water, when the cooler is in use, flows from said area into the channels and outwardly therealong, a water inlet to said water receiving area, said water inlet being connected to a water delivery line leading from the outlet side of said pump, the relative locations of said tray-like water distributing member and said cooler pad assembly being such that water issuing from the water flow channels runs downwardly over a peripheral edge of the tray-like member and through said cooler pad assembly.

2. An evaporative air cooler according to claim 1 wherein said tray-like water distributing member peripheral edge is U-shaped, said water flow channels extending between said U-shaped peripheral edge and said water receiving area, said water inlet being located centrally of said water receiving area, and flanges upstanding from an end of said tray-like water distributing member lying contiguous with the underside of said top panel.

3. An evaporative air cooler according to claim 2 wherein said cooler pad assembly comprises an evaporative pad convexly curved about its central vertical axis such that its cross-sectional shape is substantially identical to the U-shape profile of said water distributing member, said distributing member locating on the upper edge of the evaporative pad.

4. An evaporative air cooler according to claim 1 further comprising a downwardly projecting boss integrally formed with the top panel and locating over said water receiving area so as to form therewith a chamber into which water, pumped upwardly through said water inlet, flows before entering said water flow channels, said water receiving area and said boss being circular in shape and the diameters of each of which being approximately the same.

5. An evaporative air cooler according to claim 4 where said tray-like water distributing member has upstanding circumferentially spaced pin engaging in complementary shaped sockets integrally formed on the underside of said top panel so as to fixedly locate said water distributing member relative to said top panel.

6. An evaporative air cooler according to claim 1 wherein the wall defining said water receiving area has a portion thereof which slopes downwardly away from the water inlet and merges smoothly with the bottom walls of the water flow channels.

7. An evaporative air cooler according to claim 6 wherein the respective lengths and slope of those said water flow channels radiating approximately towards the rear of the cooler body are respectively less than and greater than the lengths and slope of those said water flow channels which radiate approximately towards the sides of the cooler body.

8. An evaporative air cooler according to claim 1 wherein said water flow channels radiate away from said area around most but not all of its periphery, and wherein alternate said ribs terminate at their radially inner ends a slight distance shorter than their adjacent ribs and have their ends sloping to form ramp surfaces.

* * * * *